US010596533B2

(12) United States Patent
Helle et al.

(10) Patent No.: US 10,596,533 B2
(45) Date of Patent: Mar. 24, 2020

(54) IMPELLER BOTTLE WITH AN ELONGATED EVACUATION TUBE

(71) Applicant: Medi-Physics, Inc., Princeton, NJ (US)

(72) Inventors: Kevin M. Helle, Bartlett, IL (US); Robert F. Chisholm, Princeton, NJ (US); Jay Christopher Reed, Arlington Heights, IL (US); Michael T. Schneider, Crystal Lake, IL (US)

(73) Assignee: MEDI-PHYSICS, INC., Princeton, NJ (US)

( * ) Notice: Subject to any disclaimer, the term of this patent is extended or adjusted under 35 U.S.C. 154(b) by 678 days.

(21) Appl. No.: 15/107,340

(22) PCT Filed: Dec. 22, 2014

(86) PCT No.: PCT/EP2014/079042

§ 371 (c)(1),
(2) Date: Jun. 22, 2016

(87) PCT Pub. No.: WO2015/101542

PCT Pub. Date: Jul. 9, 2015

(65) Prior Publication Data

US 2017/0001159 A1 Jan. 5, 2017

Related U.S. Application Data

(60) Provisional application No. 61/922,372, filed on Dec. 31, 2013.

(51) Int. Cl.
*B01F 13/08* (2006.01)
*B01F 15/02* (2006.01)

(52) U.S. Cl.
CPC ..... *B01F 13/0854* (2013.01); *B01F 13/0845* (2013.01); *B01F 15/0272* (2013.01); *B01F 15/0291* (2013.01)

(58) Field of Classification Search
CPC ..... B01F 13/0854; B01F 13/0845; B01F 15/0272; B01F 15/0291; B01F 13/0827; B01F 13/0863; B01F 13/0818
(Continued)

(56) References Cited

U.S. PATENT DOCUMENTS 3,207,489 A * 9/1965 Berman ..... B01F 7/0005 366/308
3,299,026 A * 1/1967 Lang ..... C08F 110/02 159/16.1

(Continued)

FOREIGN PATENT DOCUMENTS

CN 101977673 B 8/2013
DE 1801546 A1 * 10/1970 ..... B01F 13/0211

(Continued)

OTHER PUBLICATIONS

International Search Report and Written Opinion regarding International Application No. PCT/EP2014/079042, dated May 28, 2015, 14 pages.

(Continued)

*Primary Examiner* — Charles Cooley
(74) *Attorney, Agent, or Firm* — Arent Fox LLP

(57) ABSTRACT

A mixing device including a container defining a container cavity, the container including a bottom wall supporting a hollow shaft, the shaft supporting an impeller thereon such that the impeller is free to rotate about the shaft, the impeller including a central passageway therethrough for receiving the shaft, the container further including an elongated evacuation tube having a first end positioned within the passageway of the shaft and an opposed second end extending to a port of the container. Methods of using the mixing device to provide improved cell culture.

8 Claims, 6 Drawing Sheets

(58) Field of Classification Search
USPC ..... 366/273–274, 308
See application file for complete search history.

(56) References Cited

U.S. PATENT DOCUMENTS

| | | | | | |
|---|---|---|---|---|---|
| 3,649,465 | A * | 3/1972 | Scharf et al. | B01F 13/0827 | 366/244 |
| 3,744,764 | A * | 7/1973 | Sedam | B01F 13/0827 | 222/137 |
| 3,863,903 | A * | 2/1975 | Brehmer | B05B 7/2408 | 366/274 |
| 4,355,906 | A * | 10/1982 | Ono | B01F 7/0005 | 366/274 |
| 4,649,118 | A * | 3/1987 | Anderson | B01F 11/04 | 366/255 |
| 5,061,079 | A * | 10/1991 | Shiobara | B01F 13/0827 | 366/127 |
| 5,183,336 | A * | 2/1993 | Poltorak | B01F 7/0005 | 366/273 |
| 5,326,167 | A * | 7/1994 | Ware | B01F 7/001 | 366/247 |
| 2005/0206260 | A1 | 9/2005 | Akiyama | | |
| 2009/0045535 | A1* | 2/2009 | Miyashita | B01F 7/166 | 264/8 |
| 2009/0194609 | A1 | 8/2009 | Burton et al. | | |
| 2011/0038222 | A1 | 2/2011 | Ludwig et al. | | |
| 2017/0001159 | A1* | 1/2017 | Helle | B01F 13/0845 | |

FOREIGN PATENT DOCUMENTS

| | | | | | |
|---|---|---|---|---|---|
| DE | 2017472 | A1 * | 11/1971 | B01F 13/0827 | |
| DE | 41 18 709 | A1 | 12/1992 | | |
| FR | 2 402 471 | A1 | 4/1979 | | |
| FR | 2402471 | A1 | 4/1979 | | |
| FR | 2402471 | B1 | 10/1981 | | |
| FR | 2 557 473 | A1 | 7/1985 | | |
| GB | 2 185 862 | A | 7/1987 | | |
| GB | 2185862 | A * | 7/1987 | | |
| GB | 2185862 | B | 1/1990 | | |
| GB | 2400918 | A | 10/2004 | | |
| JP | H05-76581 | A | 3/1993 | | |
| JP | H0576581 | A | 3/1993 | | |
| JP | 2005269709 | A | 9/2005 | | |
| WO | 2008/098274 | A1 | 8/2008 | | |
| WO | 2013/104203 | A1 | 7/2013 | | |
| WO | WO-2015101542 | A1 * | 7/2015 | B01F 13/0845 | |

OTHER PUBLICATIONS

Machine Translation and Notification of Reasons for Refusal issued in connection with corresponding JP Application No. 2016-540603 dated Oct. 9, 2018.

Japan Office Action corresponding to JP Application No. 2016-540603, dated May 21, 2019.

China First Office Action corresponding to Chinese Application No. 201480071690.8, dated Mar. 5, 2019.

China Search Report corresponding to Chinese Application No. 201480071690.8, dated Feb. 25, 2019.

* cited by examiner

IMPELLER BOTTLE WITH AN ELONGATED EVACUATION TUBE

CROSS-REFERENCE TO RELATED APPLICATIONS

This application is a filing under 35 U.S.C. 371 of international application number PCT/EP2014/079042, filed Dec. 22, 2014, which claims priority to U.S. application No. 61/922,372, filed Dec. 31, 2013, the entire disclosures of each of which are hereby incorporated by reference.

FIELD OF THE INVENTION

The present invention relates to the production of radiopharmaceuticals. More particularly, the present invention is directed to a system and method for mixing fluids.

BACKGROUND OF THE INVENTION

The art knows of using magnetically-driven stir bars, or impellers, within a formulation bottle for mixing the fluid contents of the container. The impeller is manually emplaced to be centrally-located over the bottom of the formulation bottle such that an external magnetic drive will be able to rotate the impeller within the formulation bottle. The placement of the impeller must ensure that the impeller is properly located over the magnetic drive as positioning the impeller off-center of the axis of rotation of the magnetic drive will cause the impeller to spin out of position, requiring the process to be shut down while the impeller is repositioned.

The current method of adding the stir bar to the fluid can cause numerous problems. First, the stir bar must be dropped through an open port on the top of the formulation bottle. Having an opening on the top of the formulation bottle is highly undesirable since it contains a radioactive solution. Once the stir bar is deposited into the formulation bottle it must be perfectly centered inside the formulation bottle, and thus centered on the magnetic drive underneath the formulation bottle. If the stir bar is not perfectly centered it will be magnetically driven off path (out of the center) and not rotate correctly to produce the vortex needed for the homogeneous mixture. If this happens it is common to try to adjust the stir bar inside the bottle with a long needle, or by tilting the bottle to try to center the stir bar.

Using a long needle is undesirable due to the radiation exposure associated with handling a long needle above the bottle. Adding additional contact materials into the bottle is also undesirable since the solution is ultimately used for human injection. Tilting the bottle to try to center the stir bar is also undesirable since the radiation exposure to the operator will be greater, and also because the bottle is usually inside of high Z material for radiation shielding and not easily accessible. Numerous formulation bottles have been cracked or even broken due to this type of manual manipulation to resolve this type of issue. Sterility, or at a minimum sanitization, of the stir bar and/or method of centering the stir bar is also a challenge to the current method. It is also possible that the stir bar is centered in the formulation bottle, but the magnetic drive is dialed up too quickly, this commonly causes the stir bar to jump out of the center location and will require the stir bar to be re-centered. There is quite a bit of technique and experience required to deposit the stir bar correctly and to increase the magnetic drive enough to produce the vortex required to produce a homogeneous mixture, without increasing the magnetic drive too high causing the stir bar to jump out of center.

Another problem associated with the current method is dropping the stir bar into the solution causing a crack or even break in the formulation bottle. A final issue related to the current method is that the formulation bottle is located inside of a heavy high Z material for shielding the operator from the radioactive field, because of this the visual confirmation of a stir bar being correctly dropped, or even correctly working, can be extremely challenging. It is possible to position mirrors above the bottle to see the vortex from a correctly positioned and working stir bar, but this can also be challenging since re-positioning or re-working an added stir bar would be observed as a mirrored image, and thus not necessarily advantageous to the operator.

Another issue associated to the currently used formulation bottle is that the fluid needs to be extracted from the lowest position of the bottle to get as much fluid as possible. This is currently accomplished by placing a needle, or in some cases a tube, through a hole or septum at the top of the bottle with the tip of the needle, or end of the tube, being positioned in the bottom of the bottle. This can cause interference with the stir bar mentioned above, or can cause several other undesirable issues. Another issue related to this current method is associated with the radioactive nature of the material inside the bottle, and the extremity exposure to the operator positioning the needle and/or tubing. If there are any blockages in the fluid path, or repositioning is required for any reason, the operator is exposed to this radioactive field. There are sterility, or at a minimum of sanitization, issues associated to the different fluid path materials used for this method. If a needle tip, or the end of a tube, are not positioned exactly right there will be a reduced volume extracted from the formulation bottle.

Thus, the current process of manually adding an extraction needle or tube include, setting the needle or tube in the lowest position, where operator to operator variability of placing the extraction path can vary the results from batch to batch. Additionally, adding more fluid path or handling devices into the container can cause sterility or additive bio-burden associated with the multiple fluid path components or devices. There is again the risk of operator exposure to the product fluid while trying to position or re-position a tube to the lowest portion of the container, which are made more difficult by the container being located within an outer shielding container.

There have been numerous failed formulation lots due to these issues; in addition, there have been diminished production volumes because of the limits of the current method and equipment.

SUMMARY OF THE INVENTION

In view of the needs of the art, the present invention address numerous issues found with the currently used methods and devices, providing a more efficient and user friendly design that reduces the risks associated with this process and method. The present invention addresses these issues, optimize the process, eliminate operator to operator variability and offer a lower risk more ergonomically friendly solution.

Towards this end, in one embodiment the present invention provides a pre-fixed stir bar and a pre-fixed extraction tube. In one embodiment, the pre-fixed extraction tube extends between a port of the formulation bottle, down through the bottle cavity and around the rotation path of the stir bar to the lowest portion of the bottle cavity.

In another embodiment, the stir-bar rotates about a hollow shaft which accepts one end of the extraction path therethrough so that the extraction path extends from below the stir bar, through the stir-bar and up to a port on the formulation bottle. In this embodiment, the formulation bottle includes an elongate shaft to support a stir bar, or impeller. The shaft is connected to the bottom of the formulation bottle and is hollow and open at both ends. An evacuation tube has one end inserted into the shaft and an opposed end positioned in a port of the formulation bottle. The evacuation tube is thus positioned to withdraw fluid from the lowest point in the formulation bottle while the stir bar is held in position by the shaft, about which the stir bar may be turned by a magnetic driver.

The present invention also provides a solid shaft onto which the stir bar is positioned. An evacuation tube is shaped to run from the lowest portion of the formulation bottle, radially-outward from the path of the stir bar and up to a port of the formulation bottle.

DETAILED DESCRIPTION OF THE PREFERRED EMBODIMENTS

The formulation bottle requires a method for mixing the contained fluids. These fluids may be from multiple sources such as bulk material and diluent or pH adjustment buffering solution(s). In addition, the formulation bottle must be the source of a homogeneous solution. Because of this the formulation bottle is physically located on top of a magnetic drive, and a magnetic stir bar is added to the formulation bottle to drive this rotational vortex style mixing. The magnetic stir bar is not supported within the formulation bottle, that is, it rotates on its own within the fluid as directed by the magnetic drive. The magnetic drive is a simple off the shelf unit that has a flat top surface for placing a bottle on top of. The added stir bar can be of several different styles, and is added to the fluid for driving the mixing process. The stir bar is typically coated with a PTFE layer so it is resistant to chemicals, and does not contaminate the fluids it is mixing.

The bottles of the instant invention are desirably formed from a pharmaceutically-acceptable material, ie, a material which is compatible and suitable for uses with pharmaceutical product fluids. The present invention contemplates that the bottles of the present invention are formed from a suitable grade of glass, ceramic or polymer. All of the other fluid-contacting components of the present invention are similarly contemplated to be formed from materials suitable for use with pharmaceutical product fluids.

Figure 1:
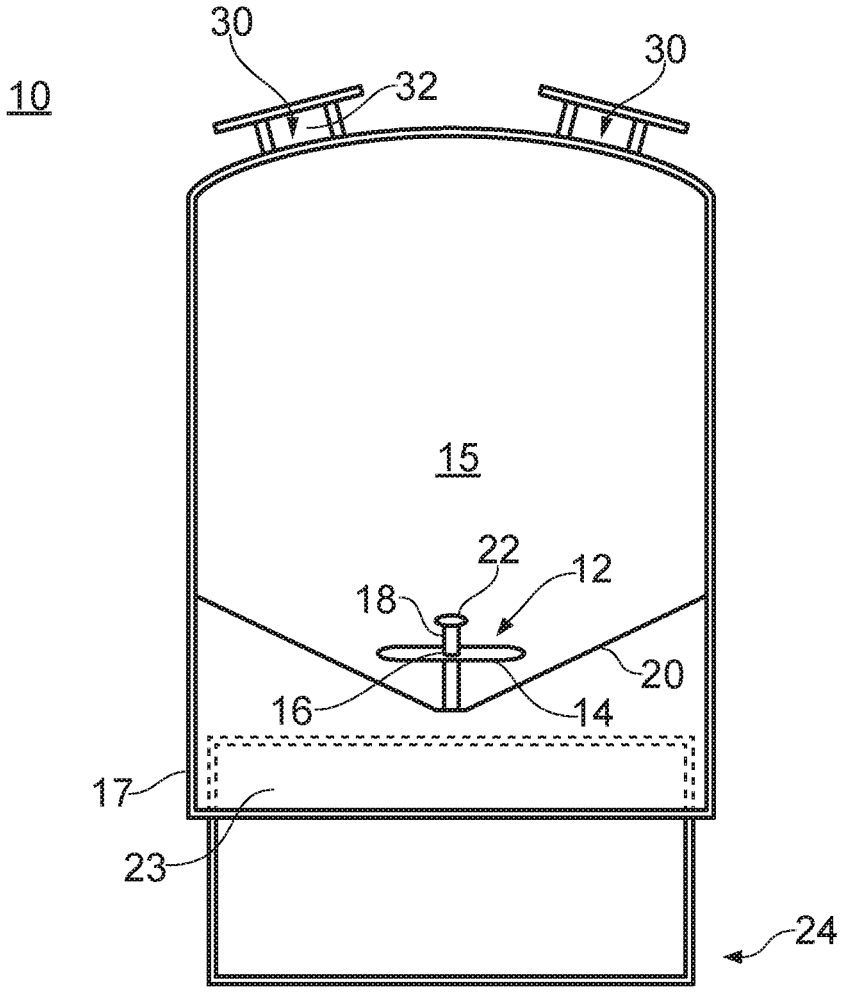
FIG. 1 depicts a first formulation bottle of the present invention.

Referring to FIG. 1, the present invention provides container 10 defining a cavity 15 having a stir bar 12 that can be added to the formulation bottle during the manufacturing process, and be provided as part of the bottle itself. Bottle 10 includes a depending annular skirt 17 which defines a magnet cavity 23 for receiving a magnetic drive 24 therein. Magnetic drive 24 provides a rotating magnetic field which magnetically couples with and causes stir bar 12 to rotate within cavity 15. Stir bar 12 includes a magnetizable material so as to interact with drive 24. Stir bar 12 may thus be formed from the magnetizable material or may be formed from a suitable glass, ceramic, or polymer which either supports or encases a magnetizable material as is known for stir bars in the art. Stir bar 12 include an elongated stir bar body 14 is provided defining a centered aperture 16 extending through it. Centered aperture 16 extends perpendicular to the long axis of the stir bar, and receives a fixed shaft 18 therethrough. Shaft 18 is centrally mounted to the bottom wall 20 of formulation bottle 10. Stir bar 12 will then be rotated in this fixed and centered position in the location ideal for producing the mixing vortex. Shaft 18 may further support a hub 22 at the free end thereof sized to prevent shaft 18 from being separated from stir bar 12 during rotation. Desirably, shaft 18 and hub 22 are formed from the same material as bottle 10 so as to reduce the number of materials contacted by the product fluid. This fixed path for rotation provided by the shaft 18 will also prevent stir bar 12 from driving off center if the magnetic drive 24 is turned to rotate at too high a speed. By having stir bar 12 mounted during the manufacturing process of bottle 10 will allow sterilization, or at a minimum sanitization, of the entire bottle assembly before use and avoid the need to re-center stir bar 12 as it will remain on the axis of rotation.

Another issue associated to the currently used equipment is that the fluid needs to be extracted from the lowest position of the bottle to get as much fluid as possible. This is currently accomplished by placing a needle, or in some cases a tube, through a port 30, or through a septum 32 spanning the port 30, defined at the top of bottle 10 with the tip of the needle, or end of the tube, being positioned in the bottom of the bottle. This can cause interference with the stir bar mentioned above, or can cause several other undesirable issues. Another issue related to this current method is associated with the radioactive nature of the material inside the bottle, and the extremity exposure to the operator positioning the needle and/or tubing. If there are any blockages in the fluid path, or repositioning is required for any reason, the operator is exposed to this radioactive field. There are sterility, or at a minimum of sanitization, issues associated to the different fluid path materials used for this method. If a needle tip, or the end of a tube, are not positioned exactly right there will be a reduced volume extracted from the formulation bottle.

Figure 2:
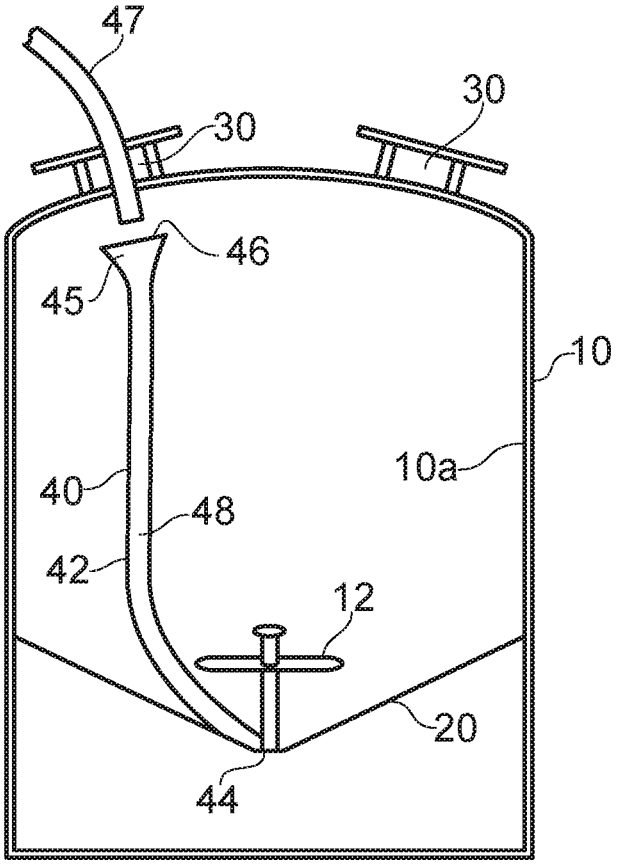
FIG. 2 depicts a second formulation bottle of the present invention, providing a pre-fixed extraction path for the formulation bottle of FIG. 1.
Figure 3:
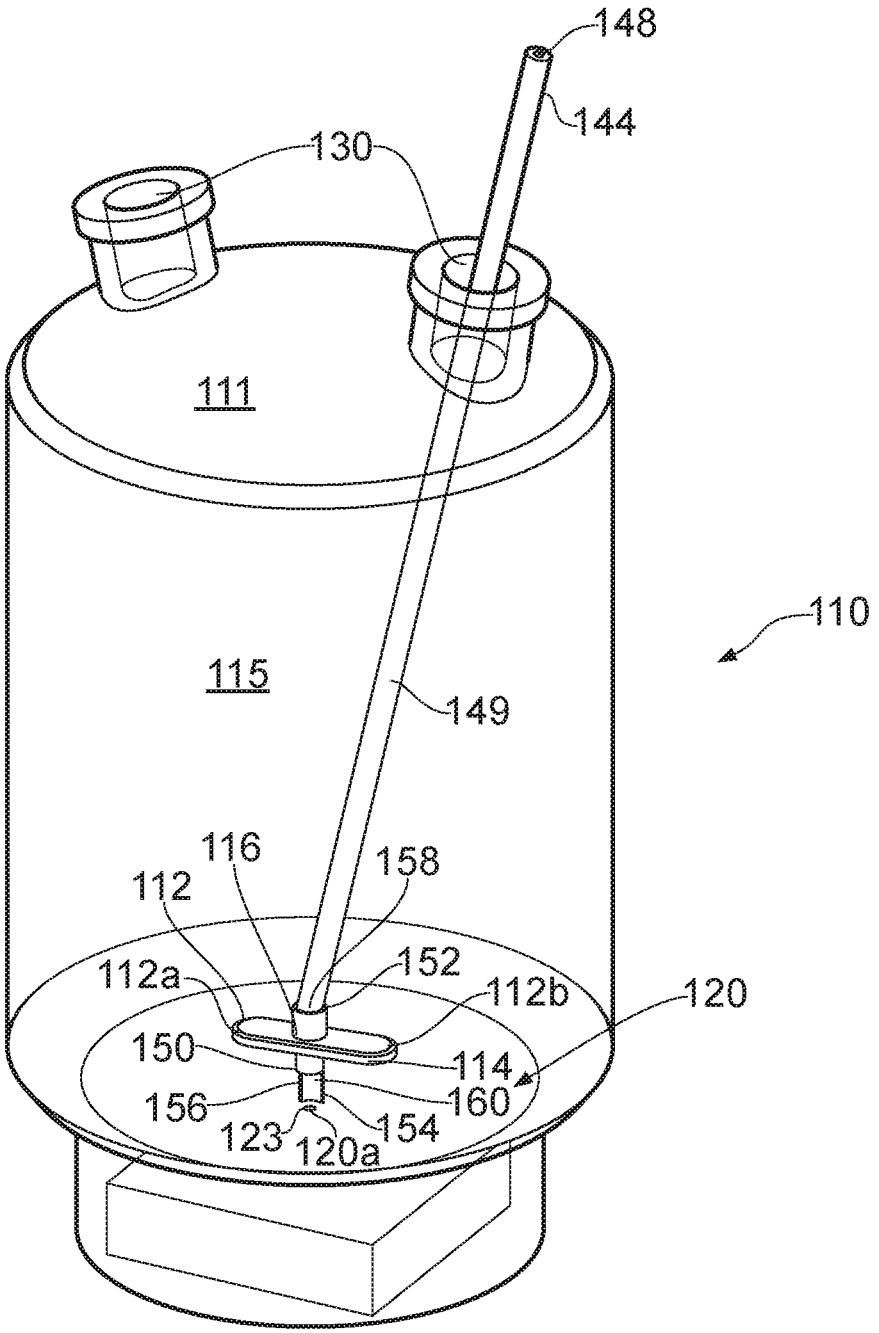
FIG. 3 depicts another formulation bottle of the present invention positioned over a magnetic driver for the stir-bar of the formulation bottle.
Figure 4:
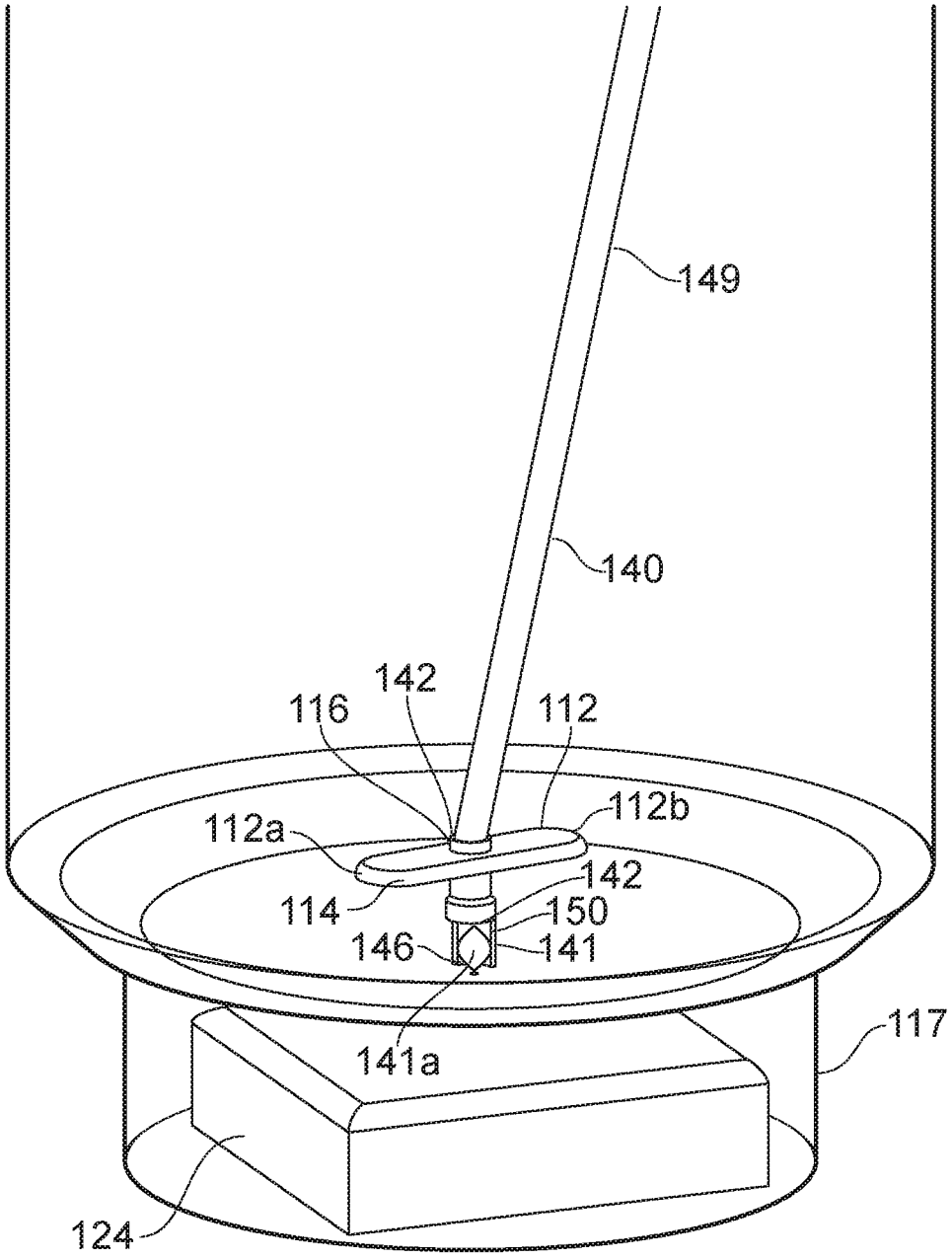
FIG. 4 depicts a close-up about the stir-bar of the formulation bottle of FIG. 3.

With reference to FIG. 2, the present invention also provides a fixed elongate hollow fluid path 40 that extends through cavity 15 of formulation bottle 10, terminating at the lowest part of bottle 10 for maximum fluid extraction. Fluid path 40 includes an elongate hollow conduit 42 defining opposed first and second open ends 44 and 46, respectively, and an elongate conduit passageway 48 extending in fluid communication therebetween. Desirably, fluid path 40 is be fixed to the interior surface 10*a* of bottle 10, extending around the rotation path of stir bar 12, so that there is no interference with the mixing process. Open end 44 of fluid path 40 can include an ideal geometry for cooperating with the surface of bottom wall 20, such as with the opening facing downward to maximize the extraction. Open end 46 of fluid path 40 desirably extends through or within port 30 or can terminate towards the top of the formulation bottle so that an external tube 47 can be easily inserted through port 30 so as to connect with open end 46. Open end 46 may further include a fluted or tapering surface 45 sized to be larger than the outer dimention of tube 47 so as to enable easier connecting of the two. Open end 46 will provide a hard stop so that it is obvious that the fluid path from outside of bottle 10 to bottom wall 20 has been completed during the connection process.

Referring now to FIGS. 3-11, in another embodiment, the present invention provides a formulation bottle 110 for mixing ingredients. Formulation bottle 110 includes a container body 111 defining a container cavity 115. Container body 111 further defines one or more ports 130 in fluid communication with container cavity 115. The present invention that separate ports 130 may be provided by container body 111 for delivering different fluids or materials to be mixed as well as for allowing samples of the fluid to be taken from container cavity 115 for quality assurance purposes or other testing. Container body 111 also includes a bottom wall 120. Desirably, bottom wall 120 has a conical or tapered shape so as to provide a lowest most point 120*a* in container cavity 115 where fluid will collect. Desirably lowest most point 120*a* is located at the center of bottom wall 120. The present invention contemplates that bottom wall 120 includes a substantially planar portion surrounding a dimple, or depression, 123 in bottom wall 120 which provides the lowest point 120*a* where fluid will collect.

Figure 5:
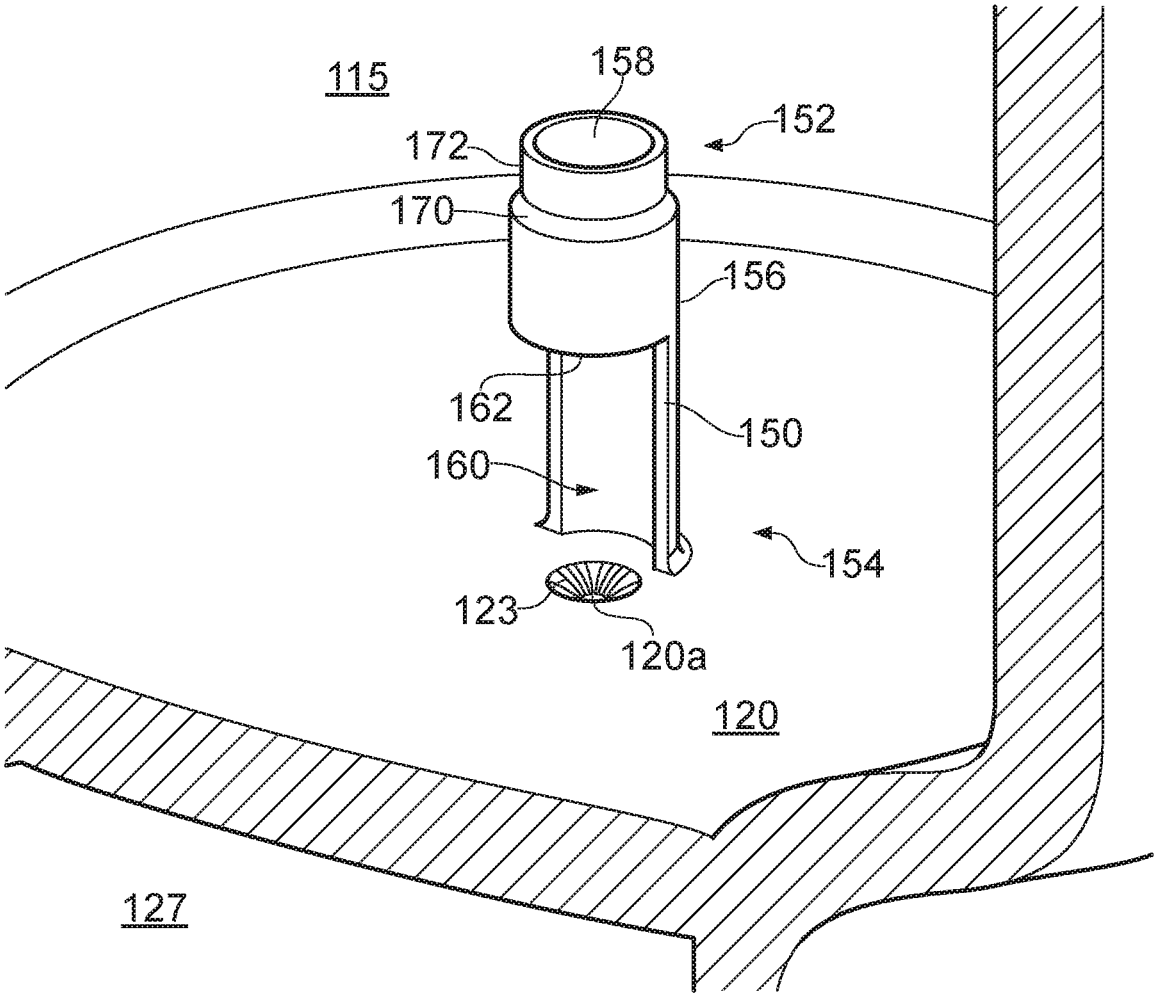
FIG. 5 depicts a shaft of the formulation bottle of FIG. 3.
Figure 11:
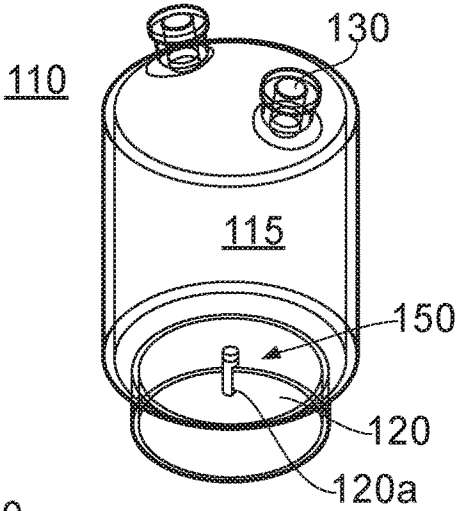
FIG. 11 depicts a side elevational view of the bottle of FIG. 3.
Figure 8:
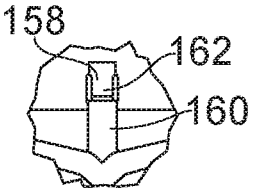
FIG. 8 depicts a cross-sectional view of the shaft of FIG. 7 taken through the line H-H.
Figure 9:
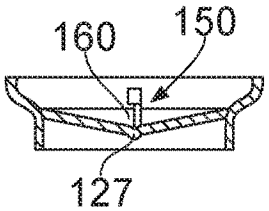
FIG. 9 depicts the shaft of FIG. 6 in detail.
Figure 7:
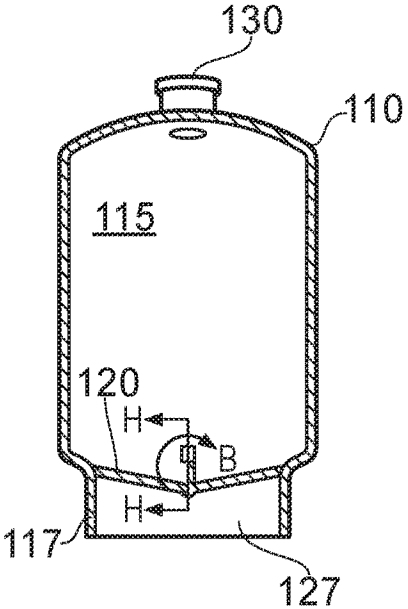
FIG. 7 depicts a cross-sectional view of the formulation bottle of FIG. 6 taken through the line A-A.
Figure 6:
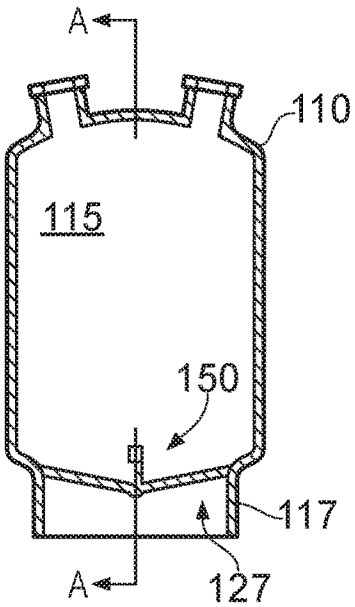
FIG. 6 depicts a front view of the formulation bottle of FIG. 3.
Figure 10:
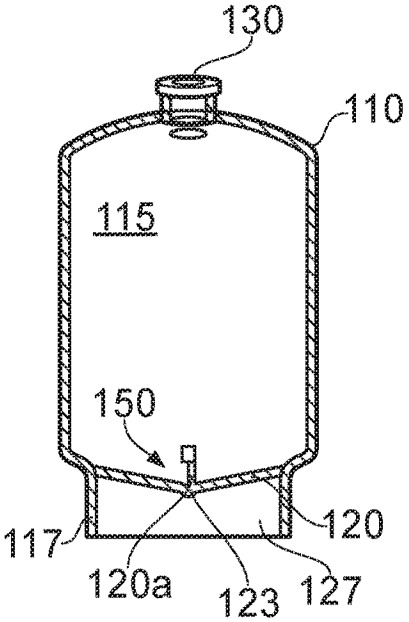
FIG. 10 depicts a side view of the bottle of FIG. 3.

The formulation bottle 110 of the present invention also includes a hollow impeller shaft 150 including a first end 152, a second end 154, and an elongate shaft body 156 extending therebetween. First end 152 defines a first shaft aperture 158, second end 154 defines a second shaft aperture 160, and shaft body 156 defines an elongate passageway 162 extending in fluid communication between first and second shaft apertures 158 and 160. The present invention contemplates that the second shaft aperture 160 may be provided with different shapes as desired, it may be deemed to be a transversely-opening notch in shaft body 156 which provides a minimal window through which product fluid may flow to reach the lowest point 120*a* of bottom wall 120 while still maximizing the ability to draw the fluid out through conduit 140. The second shaft aperture 160 may be formed by a semi-cylindrical cut-out in the shaft body 156 as seen in FIG. 5. Second end 154 of shaft 150 is attached to bottom wall 120 within cavity 115 such that passageway 162 is in fluid communication with container cavity 115 through both first and second shaft apertures 158 and 160. Desirably, passageway 162 is in overlying registry with depression 123 and low point 120*a* so as to assist in maximizing the amount of product fluid able to be drawn from cavity 115.

Formulation bottle 110 also includes an elongate stir bar, or impeller, 112 free to rotate about shaft 150 impeller 112 includes an elongate body 114 which defines a central aperture 116 therethrough for receiving first end 152 of shaft 150. Impeller 112 includes two or more mixing blades 112*a* and 112*b* extending to either side of central aperture 116 and equally-spaced thereabout. Additionally, bottle 110 includes an elongate evacuation tube 140 having a first end 142 positioned within passageway 162 of shaft 150 and an opposed second end 144 extending to port 130 and an elongate tube body 145 extending therebetween. First end 142 of evacuation tube 140 defines a first tube aperture 146, second end 144 of evacuation tube 140 defines a second tube aperture 148, and the tube wall defines an elongate evacuation passageway 149 extending in fluid communication with first and second tube apertures 146 and 148, respectively. The present invention contemplates that first tube aperture 146 is positioned in overlying registry with the lowest point 120*a* of bottom wall 120 where fluid will collect. In one embodiment, the second end of the evacuation tube terminates at a rim 141 which extends normal to the longitudinal axis of the first end 142 of evacuation tube 140 and is positioned to be spaced from bottom wall 120. Alternatively, the present invention provides rim 141 to be tapered, or bevelled, with respect to the longitudinal axis of first end 142 of evacuation tube 140 so as to provide a distal tip 141*a* which makes contact with bottom wall 120 while still defining a gap between rim 141 and bottom wall 120 so as to maintain fluid communication between evacuation passageway 149 and container cavity 115. The gap may be selected to have a size and shape which assists in maximizing the amount of fluid withdrawn from container cavity 115.

Bottle 110 includes a depending annular skirt 117 which defines a magnet cavity 127 for receiving a magnetic drive 124 therein. Magnetic drive 124 provides a rotating magnetic field which magnetically couples with and causes stir bar 112 to rotate within cavity 115. Stir bar 112, similar to stir bar, or impeller, 12, includes a magnetizable material so as to magnetically couple with the magnetic drive 124 and rotate under the influence of magnetic drive 124. Stir bar 112 may thus be formed from the magnetizable material or may be formed from a suitable glass, ceramic, or polymer which either supports or encases a magnetizable material as is known for stir bars in the art.

Desirably, shaft 150 includes an annular rim 170 about first end 152. Upstanding from annular rim 170 is a cylindrical wall segment 172 of first end 152 of shaft 150 that is sized and shaped to extend at least partially into the central aperture 116 of impeller 112. Annular rim 170 is desirably sized to extend radially-outward of shaft 150 so that impeller body 114 rests against it, free to rotate about cylindrical wall segment 172 under the direction of magnetic drive 124. The present invention further contemplates that evacuation tube 140 may include an annular bushing affixed adjacent open end 142, the bushing being too large to extend into the central aperture of the impeller and to thus act as a hub, similar in function to hub 22 of bottle 10. Annular rim 170 and the bushing may thus fix impeller 112 in place while still permitting rotation of impeller 112 by magnetic drive 124.

Second shaft aperture 160 may be defined by shaft body 156 to be transversely-oriented with respect thereto such that second end 154 of shaft 150 does not include a complete annular span itself. Alternatively, the present invention contemplates that second shaft aperture 160 may be defined by a longitudinally-oriented, ie, substantially equally-spaced from bottom wall 120, with respect to shaft body 156 so as to be defined by an annular rim, but then also suspended over bottom wall 120 by a non-annular support which maintains it in spaced registry with the lowest point 120*a* of bottom wall 120 where fluid will collect.

While the particular embodiment of the present invention has been shown and described, it will be apparent to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective bottom walled on the prior art.

What is claimed is:

1. A device for mixing ingredients, the device comprising:

a container having a container body defining a container cavity, the container body further defining at least one port in fluid communication with the container cavity, the container body including a bottom wall;

a hollow impeller shaft including a first end, a second end, and an elongate shaft body extending therebetween, said first end defining a first shaft aperture, said second end defining a second shaft aperture, and said shaft body defining an elongate passageway extending in fluid communication between said first and second shaft apertures, the second end of said hollow impeller shaft attached to the bottom wall of said container within said cavity such that said passageway is in fluid communication with said container cavity through both said first and second shaft apertures, the fluid communication at the second end of the hollow impeller shaft is provided by a notch formed by a semi-cylindrical cut-out in said shaft body;

an elongate impeller free to rotate about the hollow impeller shaft, the impeller having an elongate impeller body defining a transversely-extending central aperture therethrough for receiving the hollow impeller shaft; and an elongate evacuation tube having a first end positioned within the passageway of the hollow impeller shaft and an opposed second end extending to a port of the container, wherein the hollow impeller shaft is formed from the same material as the container body.

2. The device of claim 1, wherein said bottom wall of said container includes a frustroconical surface.

3. The device of claim 1, wherein said second shaft aperture is transversely-oriented with respect to the shaft body.

4. The device of claim 1, wherein said first end of said evacuation tube includes a tapered rim defining an evacuation port.

5. The device of claim 4, wherein at least a portion of said rim is spaced from said bottom wall.

6. The device of claim 1, further comprising a bushing affixed to the outer surface of the evacuation tube adjacent the first end thereof so as to hold the impeller on the hollow impeller shaft.

7. The device of claim 1, wherein the container body and the hollow impeller shaft are made from materials compatible and suitable for use pharmaceutical manufacturing.

8. The device of claim 1, wherein the container body further comprises an annular skirt which defines a magnet cavity for receiving a magnetic drive therein.

* * * * *